United States Patent [19]

Kossack

[11] 4,134,618

[45] Jan. 16, 1979

[54] RESTORATION OF A LEACHED UNDERGROUND RESERVOIR

[75] Inventor: Charles A. Kossack, Plano, Tex.

[73] Assignee: Atlantic Richfield Company, Los Angeles, Calif.

[21] Appl. No.: 865,646

[22] Filed: Dec. 29, 1977

[51] Int. Cl.[2] ..... E21B 43/28

[52] U.S. Cl. ..... 299/5; 299/4

[58] Field of Search ..... 166/265–267, 166/306; 299/4, 5

[56] References Cited

U.S. PATENT DOCUMENTS

| | | | |
|---|---|---|---|
| 2,685,438 | 8/1954 | Cross, Jr. | 299/5 |
| 2,944,803 | 7/1960 | Hanson | 299/5 X |
| 3,050,290 | 8/1962 | Caldwell et al. | 299/5 X |
| 3,058,729 | 10/1962 | Dahms et al. | 299/5 |
| 3,278,233 | 10/1966 | Hurd et al. | 299/4 |
| 3,309,140 | 3/1967 | Gardner et al. | 299/5 X |
| 3,309,141 | 3/1967 | Fitch et al. | 299/5 |
| 3,407,004 | 10/1968 | Every et al. | 299/5 |
| 4,072,472 | 2/1978 | Lukes | 299/5 X |

*Primary Examiner*—Stephen J. Novosad
*Assistant Examiner*—George A. Suchfield
*Attorney, Agent, or Firm*—Ronnie D. Wilson

[57] ABSTRACT

The present invention relates to a method for the restoring of an underground reservoir subsequent to the solution mining of a mineral from a subterranean formation. More specifically, the invention relates to the cycling of clean water through a subterranean formation to decrease the total dissolved solids level of the reservoir present therein.

6 Claims, No Drawings

RESTORATION OF A LEACHED UNDERGROUND RESERVOIR

Generally, known processes for solution mining of a mineral in situ utilize an acid or alkaline leach solution for the dissolution of the mineral. An oxidant is injected into the formation along with the leach solution. The mineral is leached from the formation and recovered from a production well via a pregnant leach solution. Various procedures for recovering the mineral from the pregnant leach solution are well known, such as ion exchange.

The method of the present invention is particularly suitable for an underground reservoir which has been perturbed by the leaching of uranium; however, my invention is not so limited. The following description will be in regard to uranium leached reservoirs; however, it is apparent that it is applicable to reservoirs perturbed during the leaching of other mineral values such as copper, nickel, vanadium, molybdenum, rhenium, and selenium where similar problems are encountered.

An inherent problem of solution mining uranium via an acid or alkaline solution is the dissolving of other soluble ionic species in addition to uranium causing an increase in the level of total dissolved solids (TDS) in the reservoir fluid. Other soluble ionic species include calcium, iron, magnesium, radium, sodium, chloride, molybdenum, selenium, sulfate, and vanadium. Sources of these ions are: calcite, which dissolves to produce calcium and carbonate or bicarbonate ions; molybdenite, which produces molybdate and sulfate; and iron sulfides (marcasite and pyrite), which produce sulfate as well as both soluble and insoluble iron compounds. If such soluble species are not recovered from the pregnant leach solution during operation, they will continue to accumulate throughout the life of the leaching operation, limited only by their respective saturation maximums. The extent of this accumulation is directly measured by analysis of the TDS level of the reservoir fluid.

Primary constituents of the increased TDS level are bicarbonate, carbonate, chloride and sulfate ions. Each can be present in concentrations of several hundred ppm in a perturbed reservoir fluid. The chloride and sulfate species are extremely stable, and hence, resistant to chemical reduction.

At termination of an in situ uranium solution mining operation, it is necessary to restore the reservoir fluid to near or at its original conditions for a variety of reasons. Certain of the TDS constituents (contaminants) can be removed via conventional water purification processes. For example, the alkaline metal ions as well as chloride ions can be stripped from the fluid using ion exchange resins; however, the feasibility of such processes is limited by equipment and operating costs. Similarly, sulfate ions can be removed by precipitation of the sulfate ions in an insoluble form, for example, precipitation of insoluble barium sulfate using barium chloride as the precipitating agent. The major drawback to this method is the cost of the precipitating agent. Another restoration scheme involves pumping the contaminated fluid from the reservoir, letting native formation water flow into the contaminated region, and disposing of the contaminated fluid. Studies have shown that more than three times the volume of contaminated fluid must be pumped from the reservoir to insure approaching the original conditions within the contaminated region. The removal of such a potentially large volume of water from an aquifer may not be feasible in many areas. In addition, the removed contaminated fluid must be disposed into deep injection wells or evaporation ponds since state and federal regulatory agencies prohibit the discharge of such waters into surface waters. The costs associated with these two disposal methods are substantial. In the present invention, equipment, material, and operating costs are minimized by use of the injection and production wells already in place to cycle clean water (water having a low level of TDS, i.e., a level below the TDS level of the native water) through the leached reservoir. The cycled water is kept clean by bleeding a portion thereof to a disposal well and replacing same with clean water to reduce the TDS level of the reservoir fluid.

During the course of an in situ uranium solution mining operation, two major perturbations are inflicted upon the reservoir. Restoration of a leach reservoir to its original state is contingent upon reversal of these perturbations which are (1) the change of the reservoir from a reduced to an oxidized state and (2) the increase of the TDS level of the reservoir from a nominal 1,000 ppm to several thousand ppm. The second perturbation is a direct result of the acidization or oxidation leaching process. Therefore, there is needed a method whereby these perturbations are reversed and a leached reservoir restored to its original state for the long term.

Therefore, it is an object of the present invention to provide a method for the restoration of leached reservoirs.

A further object of the present invention is to provide a method for the restoration of leached reservoirs having high TDS levels in the fluids therein.

It is an additional objective of the present invention to provide a method for the restoration of a leached reservoir through the cycling of clean water through the reservoir to decrease the level of TDS present therein.

Other objects, aspects, and several advantages of the present invention will become apparent upon a further reading of this disclosure and the appended claims.

It has now been found that the objects of the present invention can be attained by cycling clean water through an underground reservoir which has been leached of its recoverable uranium.

In the operation of in situ leaching uranium, solution which has a high TDS level is cycled through the high permeability zones in the reservoir being leached. Through the mechanism of transverse dispersion, some of the high TDS level solution enters low permeability or tight zones in an underground uranium bearing reservoir where there is very little connective flow. The amount of transverse dispersion present (which accounts for the contacting of the tight zones) is dependent on Do, the molecular diffusion coefficient, and U, the longitudinal interstitial velocity.

The relationship is shown in the prior art where Kt, the total transverse dispersion coefficient (a measure of the amount of dispersion), is $$Kt = \underbrace{\frac{Do}{F\phi}}_{\text{term 1}} + \underbrace{0.055U\,dp}_{\text{term 2}}$$

wherein, $d_p$ = average diameter of particles

U = average interstitial velocity
Do = molecular diffusion coefficient
$\phi$ = porosity
F = formation electrical resistivity factor Therefore, during leaching the amount of transverse dispersion is very high in areas where the longitudinal velocity is high (narrow areas between injectors and producers). At high velocities, i.e., 10–30 feet/day, term 2 in the equation above is ten times term 1. Thus, large amounts of dissolved salts are dispersed into the tight zones.

It has been found that simply pumping leach solution from the reservoir to attempt restoration provides a very small longitudinal velocity in the narrow areas directed between injection and production wells, due to the radial flow profile involved and the low disposal rates into a disposal well or processing plant. Thus, term 2 in the above equation is in the same order as term 1. The diffusion of dissolved salts from the tight layers back into the highly permeable zones (where they can be pumped out) is very slow.

In the operation of the present method after the in situ mining of uranium is completed, clean water is cycled through the reservoir utilizing the injection and production wells used during leaching. The flow rate of the clean water is the same or higher than the rate used in the leaching operation. This takes advantage of both terms 1 and 2 of the above equation, and again term 2 is ten times or more than term 1. It is important to keep the cycle water clean. It can be kept clean by the use of a bleed stream going to a deep disposal well or processing plant. The disposed water is replaced by clean water having a low TDS level.

It is imperative that the TDS level of the cycling clean water be kept as low as possible to keep the concentration gradient between the tight zones and the highly permeable zones as high as possible. Thus, with the high velocities present in the reservoir during the operation of this method, Kt of the above equation will be large in the regions where Kt was large during leaching and the transfer of dissolved salts from the highly polluted tight zones will be maximized, thereby minimizing the time necessary for reservoir restoration.

The following comparative example is shown to illustrate the effective operation of the method described herein. A comparison between the use of clean water cycling and its nonuse is shown.

An ore body 35,000 square feet in area and averaging twenty feet in thickness lies at an average depth of 400 feet below the surface of the earth. The ore is primarily an unconsolidated sandstone containing approximately 15 weight percent carbonates, 2 weight percent iron sulfide, and 1 weight percent organic carbon. The total uranium content of the ore averages 0.06 percent which is primarily uraninite.

Thirty-two wells are drilled into the ore body in an array forming 12 five spot patterns. The wells are completed in only the mineralized zone which is vertically isolated by low permeability strata above and below. Prior to initiation of the uranium leaching operation, all wells are pumped to remove sand and drilling debris. Subsequently, samples of the native water of the mineralized zone are obtained from all wells and analyzed for chemical composition. Average values are shown in column 3 of the Table and define the baseline or original conditions of the reservoir.

Because of the high carbonate content of the reservoir, an alkaline leaching process is utilized rather than an acid leach. During the leaching process which continues for eighteen months, an ammonia bicarbonate enriched leachant is cycled through the formation. An oxidant is injected into the twenty injection wells along with the leachant. As the fluid travels through the formation, the oxidant reacts with solid uranium, sulfides, and other oxidizable species to produce soluble and insoluble reaction products. The soluble products dissolve in the leachant and are produced at twelve production wells, the uranium content of the leachant is stripped on a uranium specific ion exchange resin, the ammonia bicarbonate, and oxidant concentrations are restored, and the leachant is reinjected into the formation. During this continuous cycling of leachant, no significant quantities of soluble species other than uranium are stripped from the leachant, and the anion donor on the ion exchange resin, chloride, is added to the leachant. Thus, the concentrations of soluble species other than uranium in the leachant steadily increase during the operation and are limited only by their saturation or solubility maximums. At the conclusion of the leaching operation, the perturbed reservoir fluid, i.e., the leachant, is analyzed and found to have the composition shown in column 4 of the Table. A comparison of columns 3 and 4 of the Table clearly shows the magnitude of the perturbation inflicted upon the reservoir fluid. Regulatory agencies' constraints require that this perturbation be reduced to near zero prior to abandonment of the site.

A test, at a near identical site in the same ore body approximately 1,000 feet removed from the present site (edge to edge), characterizes the reservoir behavior when no external restoration efforts are attempted. Operations at this site are also conducted for eighteen months under identical operating conditions. The initial and final reservoir fluid compositions are within five percent of those of the present site. At the conclusion of the leaching operation, injection of fluid is stopped and production wells as utilized to remove fluid from the formation until the effluent concentration is within ten percent of the initial concentration shown in column 3. This pump-out removes most of the dissolved solids generated during the leaching process which were residing in the high permeability strata of the formation. At the conclusion of the pump-out, all wells are shut in for fourteen months. During this period only the naturally occurring processes within the reservoir interact with the perturbed reservoir fluid. At the end of this period, three walls are reactivated and sufficient fluid pumped from the reservoir to permit acquisition of representative reservoir fluid samples. Averages of analyses of these samples are shown in column 5 of the Table. Within experimental accuracy, only the decrease in uranium concentration occurs during this period.

Clean water is introduced into each of the twenty injection wells. Fluid is removed from the reservoir via the twelve production wells, and a portion is fed via a bleed stream to a deep disposal well; the volume of fluid bleed off is replaced by clean water and returned to the reservoir via the injection wells. The flow rate is kept sufficiently high so as to be at the same level or above the flow rate utilized during leaching. This high flow rate produces a large dispersion coefficient, Kt, of the equation herein, which results in movement of the dissolved solids concentrated in the low permeability strata into the high permeability strata where they are removed from the aquifer by the cycling water and disposed of via a bleed stream. Clean water is injected (and cycled) for four months and then the wells are shut in for eight months, during which period natural molecular diffusion brings the entire aquifer into chemical equilibrium. A sample of the aquifer water is taken after this eight-month period and the ion concentration levels found are reported in column 6 of the Table. In order to observe the effectiveness of additional clean water cycling on the dissolved solids concentration, clean water is cycled for an additional two months (six months total of clean water cycling). Again, the wells are shut in for eight months to allow equilibrium to be established. The final sampling of the wells gives the ion concentrations tabulated in column 7. (Note, these values would be effectively unchanged if the clean water cycle process consisted of a single six-month cycle period followed by a shut-in of eight months.) Direct appraisal of the effectiveness of the clean water cycling is made by comparing columns 5, 6 and 7 of the Table with column 3, the initial concentration levels. Resultant from the clean water cycling, drastic reductions in the TDS level have occurred.

The present invention has been described herein with reference to particular embodiments. Therefore, it will be appreciated by those skilled in the art, however, that various changes and modifications can be made therein without departing from the scope of the invention as presented.

ANALYSIS OF MAJOR DISSOLVED SOLIDS COMPONENTS IN RESERVOIR FLUID

| 1 Species | 2 Units | 3 Prior to Initiation of In Situ Alkaline Uranium Leaching | 4 At Completion (18 months operation) of In Situ Alkaline Uranium Leaching | 5 After 14 Month Shut In of Site (Post Leaching) | 6 After 4 Month Clean Water Cycling | 7 After 6 Month Clean Water Cycling |
|---|---|---|---|---|---|---|
| pH | | 7.4 | 7.0 | 7.2 | 7.2 | 7.2 |
| Ammonia | ppm | <1 | 145 | 130 | 24 | 10 |
| Bicarbonate | ppm | 182 | 471 | 465 | 235 | 205 |
| Calcium | ppm | 43 | 725 | 730 | 172 | 99 |
| Chloride | ppm | 243 | 950 | 946 | 375 | 300 |
| Magnesium | ppm | 10 | 100 | 95 | 26 | 17 |
| Molybdenum | ppm | <1 | 22 | 18 | 3 | 2 |
| Sodium | ppm | 187 | 578 | 580 | 260 | 219 |
| Sulfate | ppm | 42 | 2005 | 1980 | 406 | 200 |
| Uranium | ppm | <1 | 10 | <1 | <1 | <1 |
| Total Dissolved Solids | ppm | 742 | 5020 | 4980 | 1508 | 1059 |

I claim:

1. A method for the restoration of an underground reservoir subsequent to solution mining of a mineral from a subterranean formation containing same via the reduction of the level of totally dissolved solids in said reservoir which comprises cycling clean water through said reservoir.

2. The method of claim 1 wherein said clean water has a total dissolved solids level below that of the native water.

3. The method of claim 1 wherein said cycling includes bleeding the stream of high total dissolved solids water and replacing same with clean water prior to injection into said reservoir.

4. The method of claim 1 wherein said reservoir has been leached with an alkaline leach solution.

5. The method of claim 1 wherein said reservoir has been leached with an acidic leach solution.

6. The method of claim 1 wherein said mineral is selected from the group comprising uranium, copper, nickel, vanadium, molybdenum, silver, rhenium and selenium.

* * * * *